United States Patent [19]

Weiner et al.

[11] Patent Number: 5,076,458

[45] Date of Patent: Dec. 31, 1991

[54] RECYCLABLE TRASH COLLECTION STATION FOR HOUSEHOLD USAGE

[75] Inventors: Bert A. Weiner, 1021 Camino Flores, Thousand Oaks, Calif. 91360; Ravi K. Sawhney; Donald A. Brown, both of Canoga Park, Calif.

[73] Assignee: Bert A. Weiner, Thousand Oaks, Calif.

[21] Appl. No.: 632,975

[22] Filed: Dec. 24, 1990

Related U.S. Application Data

[63] Continuation-in-part of Ser. No. 535,610, Jun. 11, 1990, abandoned.

[51] Int. Cl.[5] ..... B65D 21/02

[52] U.S. Cl. ..... 220/23.86; 220/554; 220/908; 232/43.2

[58] Field of Search ..... 220/503, 527, 554, 909, 220/908, 23.83, 23.86; 232/43.1, 43.2, 43.4

[56] References Cited

U.S. PATENT DOCUMENTS

| | | | |
|---|---|---|---|
| D. 142,275 | 8/1945 | Kohen | 220/909 |
| D. 161,771 | 1/1951 | Lumley | 220/554 |
| 1,380,252 | 5/1921 | Richardson | 220/908 |
| 1,511,613 | 10/1974 | Jogrn | 220/908 |
| 3,443,745 | 5/1969 | Kleeberg | 232/43.2 |
| 3,510,055 | 5/1970 | Safford | 232/43.2 |
| 3,797,643 | 3/1974 | Shupp | 220/503 |
| 4,126,241 | 11/1978 | Klosk | 220/908 |
| 4,809,850 | 3/1989 | Laible et al. | 220/908 |
| 4,893,722 | 1/1990 | Jones | 220/503 |
| 4,923,080 | 5/1990 | Lounsbury | 220/908 |

FOREIGN PATENT DOCUMENTS

| | | | |
|---|---|---|---|
| 860887 | 2/1961 | United Kingdom | 229/908 |

*Primary Examiner*—Joseph Man-Fu Moy
*Attorney, Agent, or Firm*—Gene W. Arant

[57] ABSTRACT

A collection staton for household usage for collection of recyclable trash, having top and bottom walls, front and rear walls, and left and right side walls; one vertical edge of the front wall being hinged to an edge of one of the side walls and openable for inserting a standard collection box to be supported upon the bottom wall; a shelf attached to the rear wall and to a rearward portion of each side wall for the storage of newspapers, the top wall having an openable section forming a shelf access door; the shelf having an open space in front of it for dropping mixed recyclables into the standard collection box; the upper portion of the front wall having a section forming a box access door which is hingedly supported at its top and closable by gravity, which may be swung open for depositing cans or bottles through the open space into the standard collection box. A unique hand grip provides access for opening either the front wall or the shelf access door, while normally maintaining the housing essentially sealed against the escape of odors.

5 Claims, 3 Drawing Sheets

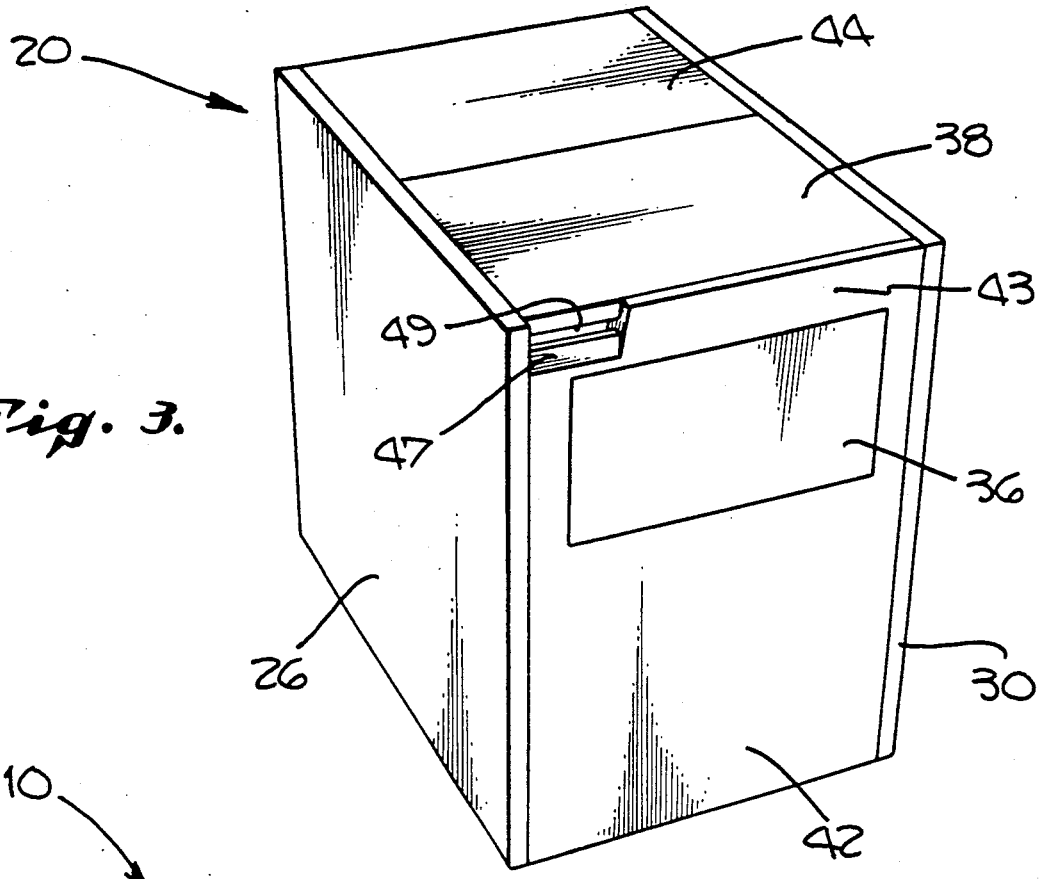
Fig. 3.
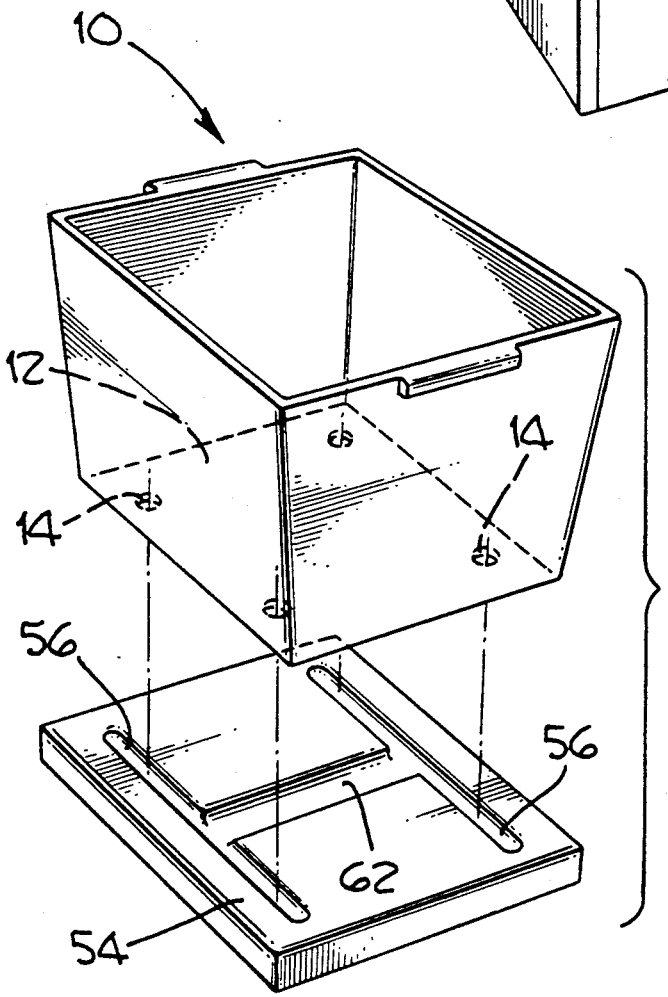
Fig. 7.
Fig. 8.
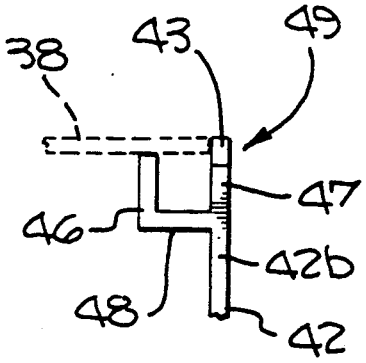

RECYCLABLE TRASH COLLECTION STATION FOR HOUSEHOLD USAGE

RELATED APPLICATION

This application is a continuation-in-part of prior copending application Ser. No. 07/535,610 filed June 11, 1990 of Bert A. Weiner, M. D., for RECYCLABLE TRASH COLLECTION STATION FOR HOUSEHOLD USAGE, subsequently abandoned. This application is under the same ownership as the prior application.

| PRIOR ART | |
|---|---|
| Culling, U. S. Pat. No. 1,618,366 | 1927 |
| Swiss patent No. 667,062 | 1978 |
| Durham, U. S. Pat. No. 4,579,243 | 1986 |
| Keppler, U. S. Pat. No. 4,775,066 | 1988 |
| Zipper, U. S. Pat. No. 4,860,910 | 1989 |
| Jones, U. S. Pat. No. 4,893,722 | 1990 |

BACKGROUND OF THE INVENTION

The recycling of trash has become of paramount importance in the United States. Many local jurisdictions have adopted regulations of varying nature as to procedures that are both available and mandatory. Such procedures generally call for newspapers and the like, cans and bottles, and other categories of trash, to be separated from each other so as to facilitate their subsequent recycling or other disposition.

Aside from the demands of government, another very important question is how the new requirements impact the average householder. It would be desirable to provide assistance to the householder in whatever he or she has to do to comply with the new procedures.

One standard that has been adopted by some local governments is the use of an open-topped plastic box for the collection of cans and bottles. The householder is required to place all cans and bottles in such a box, which is then periodically picked up and emptied by the trash collection service. In one jurisdiction the standard collection box has a capacity of fourteen gallons, and other jurisdictions may adopt a twelve-gallon or eighteen-gallon capacity as a standard.

SUMMARY OF THE INVENTION

According to the invention a collection station is provided which has one internal storage space for receiving a standard collection box, another internal storage space for holding newspapers, convenient access arrangements for placing items in both storage spaces, and convenient means for subsequently removing the contents without the necessity of lifting the standard collection box to a higher elevation. Further, the collection station is substantially fully closed to air so as to minimize any unpleasant odors which may emanate from its contents, is of such size and shape as to easily fit into a corner of a garage or patio, and is attractive in appearance.

DRAWING SUMMARY

FIG. 3 is a perspective view of the collection station of the present invention showing the access doors closed;

FIG. 7 is an exploded perspective view of a standard collection box elevated above a drip pan made in accordance with FIGS. 2 and 5; and FIG. 8 is an enlarged fragmentary side elevation view of the hand grip.

DETAILED DESCRIPTION

Figure 1:
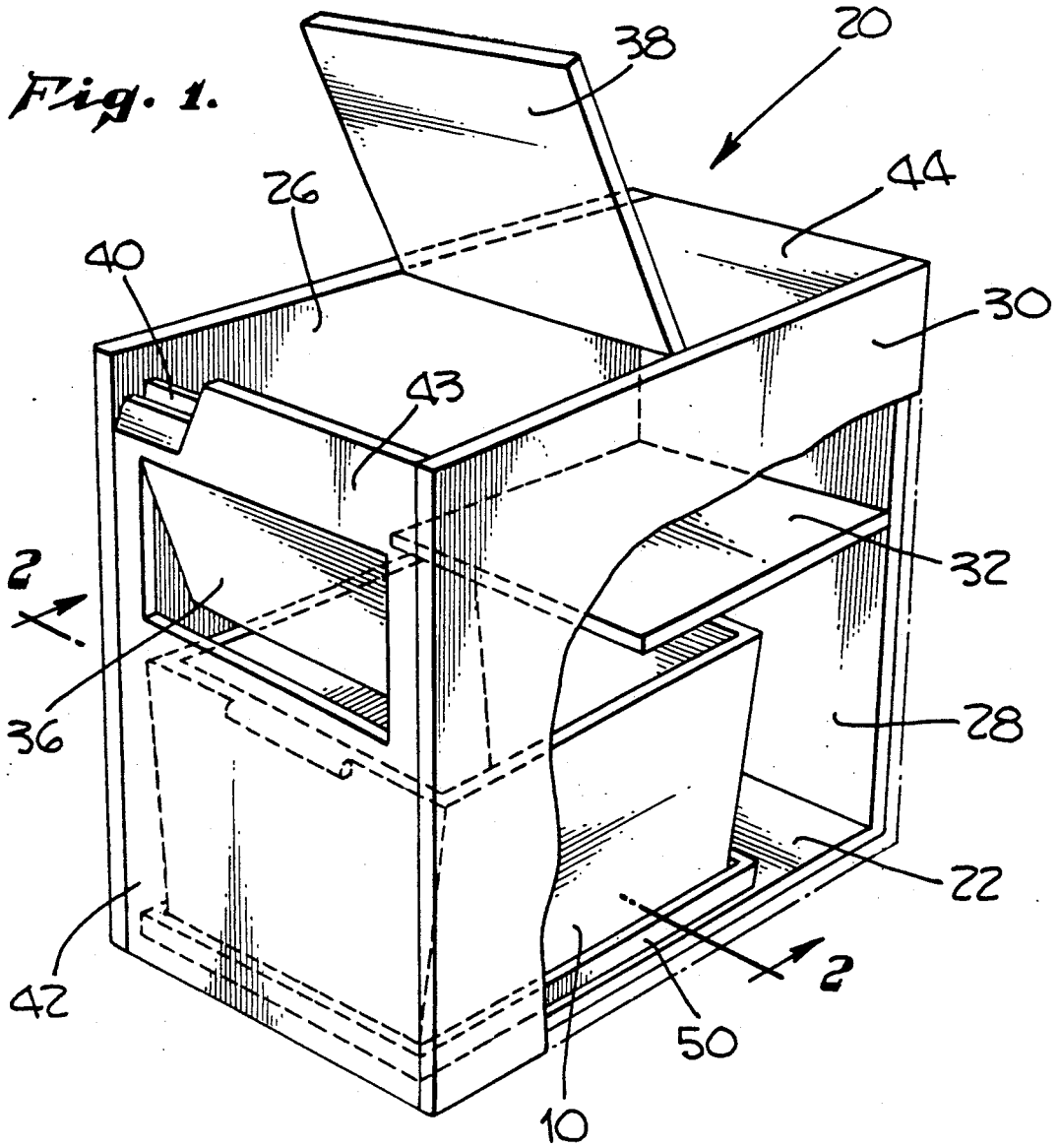
FIG. 1 is a perspective view of the collection station of the present invention with two of its access doors partially open and a standard collection box contained inside it.

One of the purposes of the collection station of the present invention is to accommodate a standard collection box or recycle bin. Such a box or bin is designated in the drawings by numeral 10, is made of plastic material, and is of rectangular shape except for a slight sloping of its walls as required for economy in manufacturing. Its flat bottom wall 12 contains a set of four drip openings 14, as best seen in FIG. 7. The standard collection box 10 is completely open at its top; that is, it has no lid or top closure.

Figure 2:
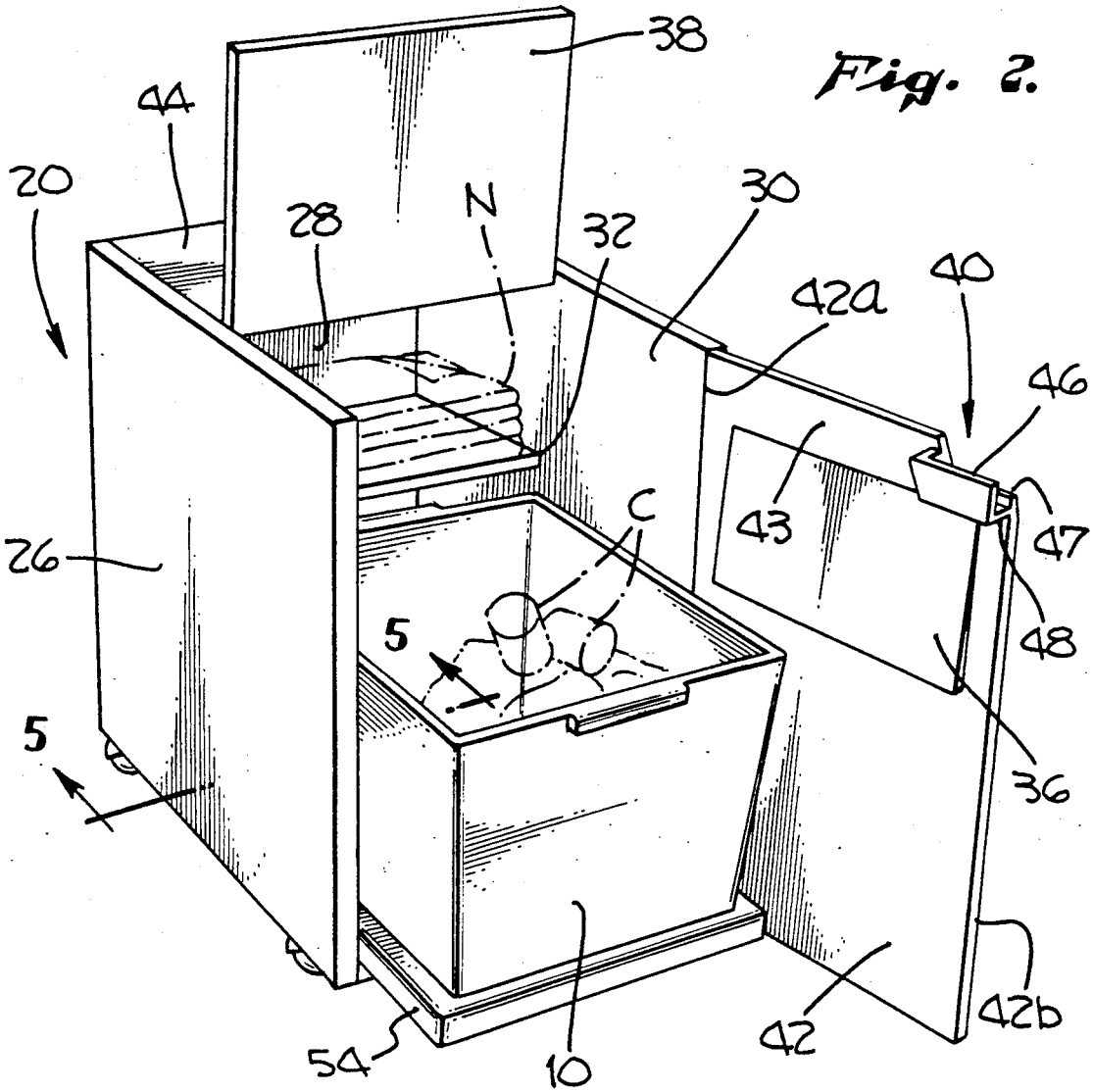
FIG. 2 is a perspective view of the collection station of the present invention showing the access doors open and the contents about to be removed.

FIG. 1 of the drawings shows the standard collection box 10 fully contained inside a trash collection station 20 that is provided in accordance with the present invention. FIG. 2 shows the standard collection box 10 partially removed from the trash collection station. FIG. 3 shows the trash collection station in its fully closed-up condition.

A trash collection station 20 in accordance with the present invention includes a housing which is of a generally box-like configuration, but has various special features. The station is constructed almost entirely of flat wall sections, including a bottom wall 22, a left side wall 26, a rear wall 28, a right side wall 30, a front wall 42, and a top wall 44, 38. In the fully closed condition of the housing as shown in FIG. 3 the front wall 42, top wall 44, 38, rear wall 28, and bottom wall 22 are all seated between the side walls 26, 30. These flat wall sections may be made of either wood or plastic. The height of collection station 20 is preferably about double its width, and its depth from front to back is preferably also about double its width.

The right-hand vertical edge **42*a* of front wall 42 is hinged to the adjacent edge of right side wall 30 so that front wall 42 may be easily swung open or closed. This feature makes it convenient to insert the standard collection box 10 into the trash collection station 30 so as to rest upon a drip pan 50 which in turn is supported on the bottom wall 22. Perhaps more importantly, the openable front wall 42 makes it convenient to remove the fully loaded box 10 from the collection station 30 without the necessity of lifting box 10** to a greater height.

A horizontal shelf 32 is attached to rear wall 28 and also to the adjacent rearward portions of the side walls, and extends forward about half the depth of the housing. It is provided for the convenient storage of newspapers and the like. Because the depth of collection station 20 from front to back is about double its width, a horizontal open space 34 is left between the front edge of the shelf 32 and the inside surface of the front wall 42. This space is provided for dropping cans and bottles into the standard collection box 10, which may be done either through a top access door or through a front access door, as will now be described. In FIG. 2 newspapers N are shown in dotted lines laying on shelf 32, while cans C shown in dotted lines occupy the standard collection box 10.

The front wall 42 has an upper portion 36 thereof which is cut away from the remainder of the wall to form a front access door. Solid sections of the front wall 42 remain on each side of the front access door, and a solid section 43 of front wall 42 also remains above the front access door. The front access door 36 is hingedly supported at its top edge from the solid wall section 43, so as to swing open only in the direction inwardly of the trash collection station. The front access door may be opened by hand, by pushing its bottom edge inwardly, for depositing cans or bottles therethrough and through the open space 34 into the standard collection box 10. The front access door 36 is closable by gravity, and if desired an appropriate spring, not specifically shown, may be used to aid that action.

The rear top wall 44 section is permanently seated between the upper extremities of the side walls 26, 30. A separate forward end portion 38 has its rearward edge hinged to the rear portion of the wall so as to swing upwardly, providing a top access door. The top access door 38 occupies approximately half the length of the top wall 44, and its size and location correspond rather closely to the dimensions of the access space 34 above collection box 10. Thus, when the front edge of the top access door 38 is lifted by hand, it provides a convenient opening for dropping cans and bottles through the space 34 into the standard collection box 10. The top access door 38 also provides convenient access for depositing newspapers onto shelf 32, and may therefore be referred to as a shelf access door.

At the upper left corner of front wall 42 a hand grip 40 is provided. This hand grip, shown in FIGS. 1, 2, 3, and 8 is used for two separate and distinct purposes. One purpose is to grip the upper left corner of front wall 42 in order to swing it outward in a horizontal direction from its hinged right vertical edge, as shown in FIG. 2, whenever a collection box 10 is to be inserted or removed. The other purpose of the hand grip 40 is to make it possible to lift the top access door 38.

More specifically, the structure and use of the hand grip 40 are described as follows. The left-hand vertical edge of front wall 42 at its upper corner has a finger access opening 49 adjacent the under surface of top access door 38. By inserting a hand with palm up, a person can engage his fingers with the underneath surface of the top access door. This action makes it possible to then vertically lift the top access door 38.

By inserting a hand through opening 49 with palm down, a person may engage a finger gripping area of the inner surface of the front wall 42 beneath the finger access opening 49. In this position the hand may be used for swinging the front wall 42, 43 together with front access door 36 horizontally outward to its open position as shown in FIG. 2.

A horizontal wall portion 48 extends inwardly underneath the finger gripping area of the inner surface of the front wall 42. An inner sealing wall 46 extends upwardly from horizontal wall portion 48 in generally parallel relation to the front wall 42 and also to the finger access opening 49. The top access door 38 when closed seatingly engages not only the upper extremities of the side walls 26, 30, but also the upper surface of the inner sealing wall 46. With appropriate sealing surfaces, the housing is then effectively sealed to minimize unpleasant odors that may emanate from its contents.

Thus as best seen in FIGS. 2 and 8, the hand grip 40 is of generally U-shaped cross-section in the vertical plane, and is open at its left-hand side which is flush with the left side edge 42*b* of front wall 42, 43. The short vertical wall section which is integral with and in the same plane as the front wall section 43, and extends above the short bottom wall section 48, is designated by numeral 47. It is the inner surface of wall section 47 which provides a finger gripping area. When top access door 38 is closed, it drops down between the side walls 26, 30, and also just behind the front wall upper section 43, coming to rest on top of the upper edge of vertical inner sealing wall 46. See FIG. 8 where the top access door is shown in dotted lines. Thus the housing remains normally closed to air. Because wall section 47 does not extend as high as wall section 46, the vertical gap 49 remains between the under surface of top access door 38 and the upper edge of wall section 47 even when the top access door is closed.

Figure 4:
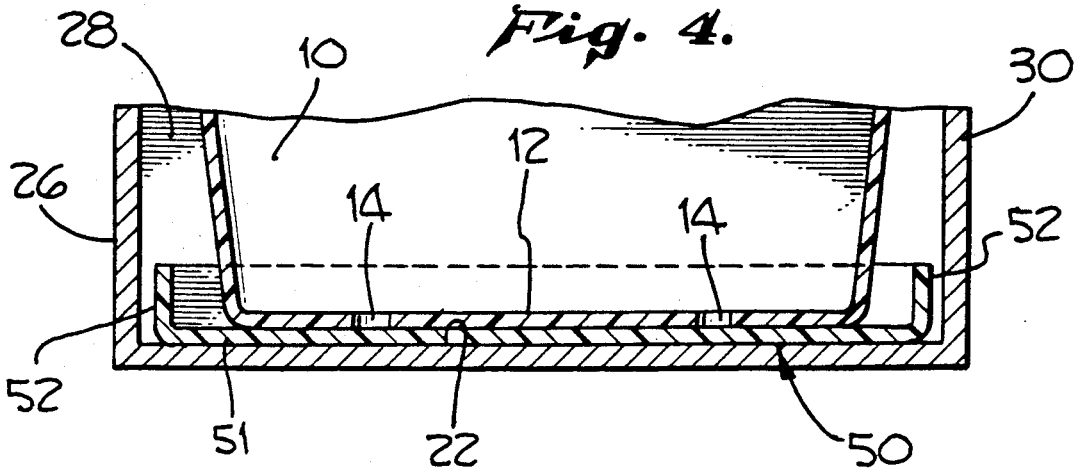
FIG. 4 is a fragmentary cross-sectional elevation view taken on Line 4—4 of FIG. 1, showing construction of a drip pan upon which the standard collection box normally rests.
Figure 6:
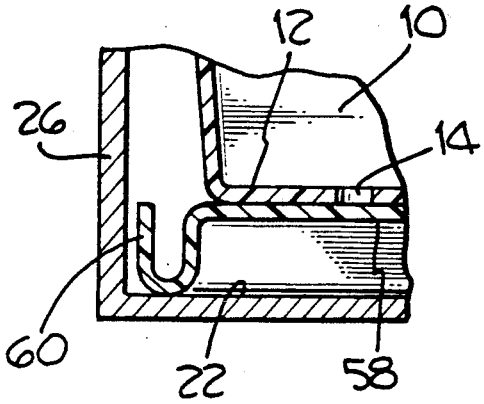
FIG. 6 is a fragmentary cross-sectional elevation view showing a third form of drip pan construction.
Figure 5:
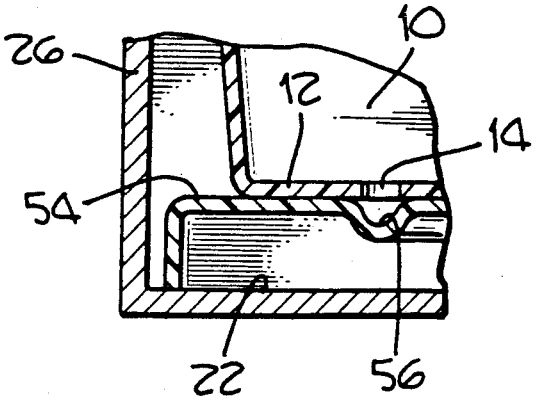
FIG. 5 is a fragmentary cross-sectional view taken on the line 5—5 of FIG. 2, showing a second form of the drip pan.

In accordance with the invention it is also greatly preferred to utilize a drip pan underneath the standard box 10, since the standard box 10 has openings 14 in its bottom wall 12 to permit fluids to run out. The drip pan may be a flat pan 50 with a short upstanding wall 52 around its periphery as shown in FIGS. 1 and 4. Alternatively, and perhaps preferably, the pan is elevated with a trough around its edge, so that upon the removal of the standard collection box when loaded it will not be necessary to raise the elevation of the collection box. Such a pan structure is shown in FIGS. 2, 5, and 6, where an upside down pan 54 has a pair of bottom grooves 56 which are upwardly open and aligned with openings 12 in the standard box, as well as a transverse central groove 62 (FIG. 7) connecting the two grooves 56. A third form of drip pan structure is shown in FIG. 6 where another form of upside down pan 58 has a trough formed all around its periphery. The drip pan, whatever its configuration, is preferably made of plastic material.

The housing of the present invention may also be provided with wheels or casters, indicated only in FIG. 2, which may be removable if their use is not desired, and one of which is also lockable for maintaining a desired location of the collection station.

The presently preferred form of the invention has been disclosed in some detail in order to comply with the requirements of the patent law. However, the scope of the invention is to be determined only in accordance with the appended claims.

What we claim is:

1. A recyclable trash collection station for household usage, including:

a container of generally box-like configuration, having top and bottom walls, front and rear walls, and left and right side walls;

said container having a first internal storage space immediately above said bottom wall which is adapted to receive a standard collection box, one vertical edge of said front wall being hinged to an edge of one of said side walls for permitting such collection box when empty to be slidably inserted into said first storage space or when fully loaded to be slidably removed therefrom without lifting it to a higher elevation;

said container having a shelf positioned above said first internal storage space, attached to said rear wall and extending forwardly therefrom, and also attached to a rearward portion of each of said side walls, the space immediately above said shelf providing a second internal storage space adapted for the storage of newspapers, said top wall having an openable section thereof forming a shelf access door for depositing newspapers onto said shelf;

said shelf having an open space in front thereof for the dropping of cans and bottles into the standard collection box;

the upper portion of said front wall having a section thereof forming a box access door which is hingedly supported at its top and whose bottom may be swung open for depositing cans or bottles therethrough and through said open space into the standard collection box, said box access door being closable by gravity; and said container normally being substantially fully closed to air so as to minimize any unpleasant odors which may emanate from its contents.

2. A recyclable trash collection station for household usage as in claim 1 wherein the other vertical edge of said front wall at its upper corner has a finger access opening adjacent the under surface of said shelf access door for permitting finger access underneath said shelf access door when it is desired to lift said shelf access door, the inner surface of said front wall having a finger gripping portion beneath said finger access opening for horizontally swinging said front wall to its open position;

a horizontal wall portion which extends inwardly from the inner surface of said front wall underneath said finger gripping portion thereof;

an inner sealing wall which extends upwardly from said horizontal wall portion in generally parallel relation to said front wall and to said finger access opening in said front wall; and said shelf access door when it is closed not only engaging the upper extremities of said side walls, but also engaging the upper surface of said inner sealing wall.

3. A recyclable trash collection station for household usage as in claim 1 wherein the height of said container is about double its width, and its depth from front to back is also about double its width.

4. A collection station for household usage for collection of recyclable trash, including:

a housing of generally box-like configuration, having top and bottom walls, front and rear walls, and left and right side walls;

one vertical edge of said front wall being hinged to an edge of one of said side walls and openable for inserting a standard collection box to be supported in a first internal storage space upon said bottom wall, or for removing the box when loaded;

a shelf attached to said rear wall and to a rearward portion of each of said side walls providing a second internal storage space adapted for the storage of newspapers, said top wall having an openable section thereof forming a shelf access door;

said shelf having an open space in front thereof for the dropping of mixed recyclables into the standard collection box;

the upper portion of said front wall having a section thereof forming a box access door which is hingedly supported at its top and which may be swung open for depositing cans or bottles therethrough and through said open space into the standard collection box, said box access door being closable by gravity; and said housing normally being substantially fully closed to air so as to minimize any unpleasant odors which may emanate from its contents.

5. A recyclable trash collection station for household usage as in claim 4 wherein the other vertical edge of said front wall at its upper corner has a finger access opening adjacent the under surface of said shelf access door for permitting finger access underneath said shelf access door when it is desired to lift said shelf access door, the inner surface of said front wall having a finger gripping portion beneath said finger access opening for horizontally swinging said front wall to its open position;

a horizontal wall portion which extends inwardly from the inner surface of said front wall underneath said finger gripping portion thereof;

an inner sealing wall which extends upwardly from said horizontal wall portion in generally parallel relation to said front wall and to said finger access opening in said front wall; and said shelf access door when it is closed not only engaging the upper extremities of said side walls, but also engaging the upper surface of said inner sealing wall.

* * * * *

UNITED STATES PATENT AND TRADEMARK OFFICE

CERTIFICATE OF CORRECTION

PATENT NO. : 5,076,458

DATED : December 31, 1991

INVENTOR(S) : Bert A. Weiner, et al

It is certified that error appears in the above-identified patent and that said Letters Patent is hereby corrected as shown below:

Column 2, line 58, the collection station "30" should read --20--; line 62, the collection station "30" should read --20--.

Column 4, line 31, after *may be a flat pan 50 with* insert the phrase --a flat bottom wall 51 and--; line 44, after *trough* insert the number --60--.

Signed and Sealed this

Twenty-ninth Day of June, 1993

*Attest:*

Michael K. Kirk

MICHAEL K. KIRK

*Attesting Officer*

*Acting Commissioner of Patents and Trademarks*